US008581830B2

(12) United States Patent
Han

(10) Patent No.: US 8,581,830 B2
(45) Date of Patent: Nov. 12, 2013

(54) LIGHT SOURCE DRIVER, METHOD OF DRIVING THE SAME AND DEVICES INCLUDING THE SAME

(75) Inventor: Hee Seok Han, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 338 days.

(21) Appl. No.: 13/026,708

(22) Filed: Feb. 14, 2011

(65) Prior Publication Data

US 2011/0204817 A1 Aug. 25, 2011

(30) Foreign Application Priority Data

Feb. 22, 2010 (KR) ..... 10-2010-0015916

(51) Int. Cl.
*G09G 3/36* (2006.01)

(52) U.S. Cl.
USPC ..... 345/102; 315/308

(58) Field of Classification Search
USPC ..... 345/82, 102; 315/209 R, 291, 307, 308
See application file for complete search history.

(56) References Cited

U.S. PATENT DOCUMENTS

| | | | | |
|---|---|---|---|---|
| 7,733,034 | B2 * | 6/2010 | Kotikalapoodi et al. | 315/294 |
| 8,081,199 | B2 * | 12/2011 | Takata et al. | 345/694 |
| 8,169,161 | B2 * | 5/2012 | Szczeszynski et al. | 315/308 |
| 2008/0001547 | A1 * | 1/2008 | Negru | 315/189 |
| 2008/0054815 | A1 * | 3/2008 | Kotikalapoodi et al. | 315/192 |
| 2009/0187925 | A1 * | 7/2009 | Hu et al. | 719/327 |
| 2012/0181939 | A1 * | 7/2012 | Szczeszynski et al. | 315/186 |

* cited by examiner

*Primary Examiner* — Thuy Vinh Tran
(74) *Attorney, Agent, or Firm* — Lee & Morse, P.C.

(57) ABSTRACT

A light source driver including an adjusting circuit configured to adjust a voltage applied to each of a plurality of light source channels in response to a plurality of comparison signals and a comparison circuit configured to compare a minimum voltage among output voltages of the respective light source channels with a plurality of reference voltages and output the plurality of comparison signals.

19 Claims, 8 Drawing Sheets

LIGHT SOURCE DRIVER, METHOD OF DRIVING THE SAME AND DEVICES INCLUDING THE SAME

BACKGROUND

1. Field

Embodiments relate to a light source driver, and more particularly, to a light source driver capable of occupying a reduced and/or minimized area of an integrated circuit (IC), a method of driving the same, and devices including the same.

2. Description of the Related Art

Light source drivers supply voltage to each of a plurality of light source channels. To minimize power consumption due to a characteristic difference between light sources, light source drivers need to actively adjust voltage applied to each of multiple light source channels.

SUMMARY

One or more embodiments may provide a light source driver employing a reduced and/or minimized area on an integrated circuit (IC) by reducing a number of comparators and/or adapted to detect a state where an erroneous operation may occur, a method of driving such a light source driver, and devices including the same.

One or more embodiments may provide a light source driver including an adjusting circuit configured to adjust a voltage applied to each of a plurality of light source channels in response to a plurality of comparison signals and a comparison circuit configured to compare a minimum voltage among output voltages of the respective light source channels with each of a plurality of reference voltages and output the plurality of comparison signals.

The comparison circuit may include a detection circuit configured to detect the minimum voltage, which is generated according to each of the output voltages of the respective light source channels and a current control voltage generated by a current source; and a comparison unit configured to compare the detected voltage with each of the plurality of reference voltages and output the comparison signals. The comparison unit may include a first comparator configured to compare the detected voltage with one of the plurality of reference voltages and output one of the comparison signals and a second comparator configured to compare the detected voltage with another one of the plurality of reference voltages and output another one of the comparison signals.

The detection circuit may include a plurality of bipolar junction transistors (BJTs) each of which may be connected between the current source and a ground. Bases of the respective BJTs may respectively receive the output voltages of the respective light source channels. The detection circuit may further include a plurality of switches connected between the current source and emitters, respectively, of the respective BJTs.

The comparison circuit may include a detection circuit configured to detect the minimum voltage according to each of the output voltages of the respective light source channels and a control voltage generated by a current generated by a current source; and a comparison unit configured to output intermediate comparison signals according to a result of comparing the detected voltage with each of the plurality of reference voltages, output a signal resulting from a logic operation on one of the intermediate comparison signals as one of the comparison signals and a signal generated by a mirror current of the current, and output another one of the intermediate comparison signals as another one of the comparison signals. The current source may be a current mirror which generates the current and the mirror current.

The comparison circuit may include a current mirror configured to generate a current, a switching circuit configured to transmit the current to a node in response to a voltage of the node and each of the plurality of reference voltages sequentially applied, a detection circuit configured to detect the minimum voltage according to each of the output voltages of the respective light source channels and a voltage generated based on the current, and a deserializer configured to sequentially buffer a mirror current of the current and generate a plurality of deserialized buffer signals respectively corresponding to the comparison signals.

One or more embodiments may provide a back light unit including a plurality of light source channels and the above-described light source driver.

One or more embodiments may provide a display device including a display panel, the above-described back light unit, and a display controller configured to control an operation of the display panel and an operation of the back light unit.

One or more embodiments may provide a display system includes the above-described display device and a processor configured to control an operation of the display device.

One or more embodiments may provide a method driving a light source driver includes adjusting a voltage applied to each of a plurality of light source channels in response to a plurality of comparison signals; and comparing a minimum voltage among output voltages of the respective light source channels with each of a plurality of reference voltages and outputting the plurality of comparison signals.

BRIEF DESCRIPTION OF THE DRAWINGS

Features will become more apparent to those of ordinary skill in the art by describing in detail exemplary embodiments with reference to the attached drawings, in which.

DETAILED DESCRIPTION

Figure 1:
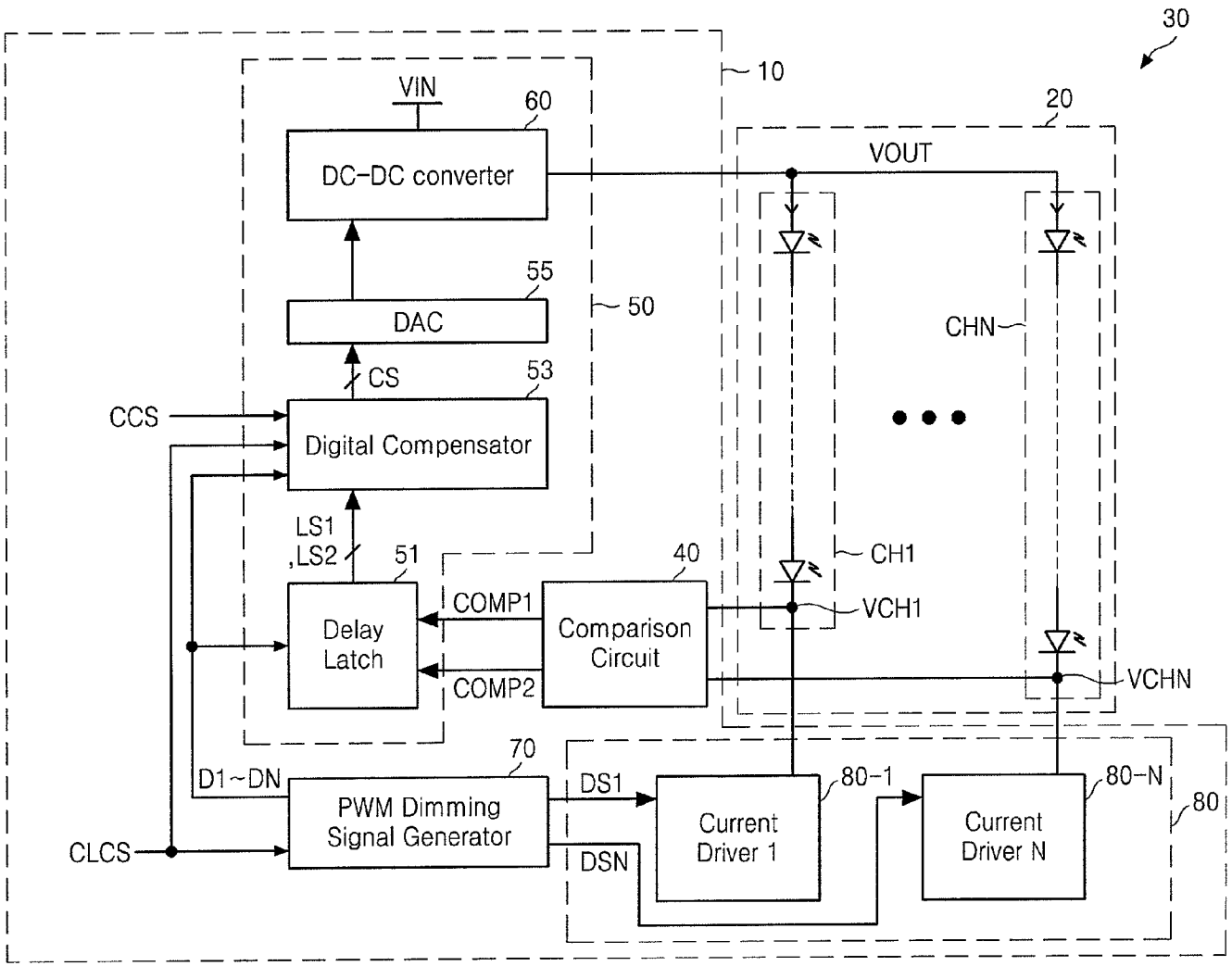
FIG. 1 illustrates a block diagram of an exemplary embodiment of a back light unit.

Korean Patent Application No. 10-2010-0015916, filed on Feb. 22, 2010, in the Korean Intellectual Property Office, and entitled: "Light Source Driver, Method of Driving the Same, and Devices Including the Same," is incorporated by reference herein in its entirety.

Exemplary embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout the specification.

It will be understood that when an element is referred to as being "connected" to another element, it can be directly connected to the other element or intervening elements may be present. In contrast, when an element is referred to as being "directly connected" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

FIG. 1 illustrates a block diagram of an exemplary embodiment of a back light unit 30. The back light unit 30 may include a light source driver 10 and a light source block 20. The light source block 20 may include a plurality of light source channels CH1 through CHN.

Each of the light source channels CH1 through CHN may include a plurality of light sources connected in series. The light sources may be implemented by light emitting diodes (LEDs), organic light emitting diodes (OLEDs), active matrix organic light emitting diodes (AMOLEDs), etc.

The light source driver 10 may actively adjust a voltage VOUT applied to the light source channels CH1 through CHN. The light source driver 10 may include a comparison circuit 40 and an adjusting circuit 50.

The adjusting circuit 50 may adjust the voltage VOUT applied to each of the light source channels CH1 through CHN in response to a plurality of comparison signals COMP1 and COMP2. The adjusting circuit 50 may include a digital compensator 53, a digital-to-analog converter (DAC) 55, and a DC-DC converter 60. The adjusting circuit 50 may also include a delay latch 51. The delay latch 51 may delay each of the comparison signals COMP1 and COMP2 output from the comparison circuit 40 by a predetermined period of time in response to one of a plurality of dimming signals D1 through DN and may output latch signals LS1 and LS2, respectively.

The delay latch 51 may or may not be provided. For example, in embodiments not including the delay latch 51, the digital compensator 53 may receive the comparison signals COMP1 and COMP2 from the comparison circuit 40. In embodiments including the delay latch 51, the digital compensator 53 may receive the latch signals LS1 and LS2 from the delay latch 51. The digital compensator 53 may output a compensation signal CS in response to a plurality of control signals. The control signals may include at least one signal among a current level change signal CLCS, the dimming signals D1 through DN, and a compensation control signal CCS. The current level change signal CLCS may be a signal for adjusting an amount of current flowing in the light source channels CH1 through CHN. The compensation signal CS may be output according to a period of the dimming signals D1 through DN.

The compensation control signal CCS may be a signal for controlling a generation period of the compensation signal CS. When one of the comparison signals COMP1 and COMP2, e.g., the first comparison signal COMP1, is at a high level, the digital compensator 53 may output the compensation signal CS for controlling the voltage VOUT applied to the light source channels CH1 through CHN to be lowered. When another one of the comparison signals COMP1 and COMP2, e.g., the second comparison signal COMP2, is at a high level, the digital compensator 53 may output the compensation signal CS for controlling the voltage VOUT applied to the light source channels CH1 through CHN to be raised. When the comparison signals COMP1 and COMP2 are all at a low level, the digital compensator 53 may output the compensation signal CS for maintaining the voltage VOUT applied to the light source channels CH1 through CHN.

The DAC 55 may convert the compensation signal CS into an analog signal. The DC-DC converter 60 may apply the voltage VOUT to each of the light source channels CH1 through CHN in response to the analog signal.

The light source driver 10 may include a pulse width modulation (PWM) dimming signal generator 70 and/or a current driving block 80. The PWM dimming signal generator 70 may output a plurality of dimming voltage signals DS1 through DSN and the dimming signals D1 through DN in response to the current level change signal CLCS. The dimming voltage signals DS1 through DSN may control an amount of current in the current driving block 80 and/or a time when the current driving block 80 is enabled. The dimming signals D1 through DN may include information about an enable time.

The current driving block 80 may generate current in response to the dimming voltage signals DS1 through DSN. The current driving block 80 may include a plurality of current drivers 80-1 through 80-N. The current drivers 80-1 through 80-N may drive the light source channels CH1 through CHN, respectively, in response to the dimming voltage signals DS1 through DSN, respectively. The comparison circuit 40 may compare a minimum voltage among output voltages VCH1 through VCHN respectively output from the light source channels CH1 through CHN with each of a plurality of reference voltages to output the comparison signals COMP1 and COMP2.

Figure 2:
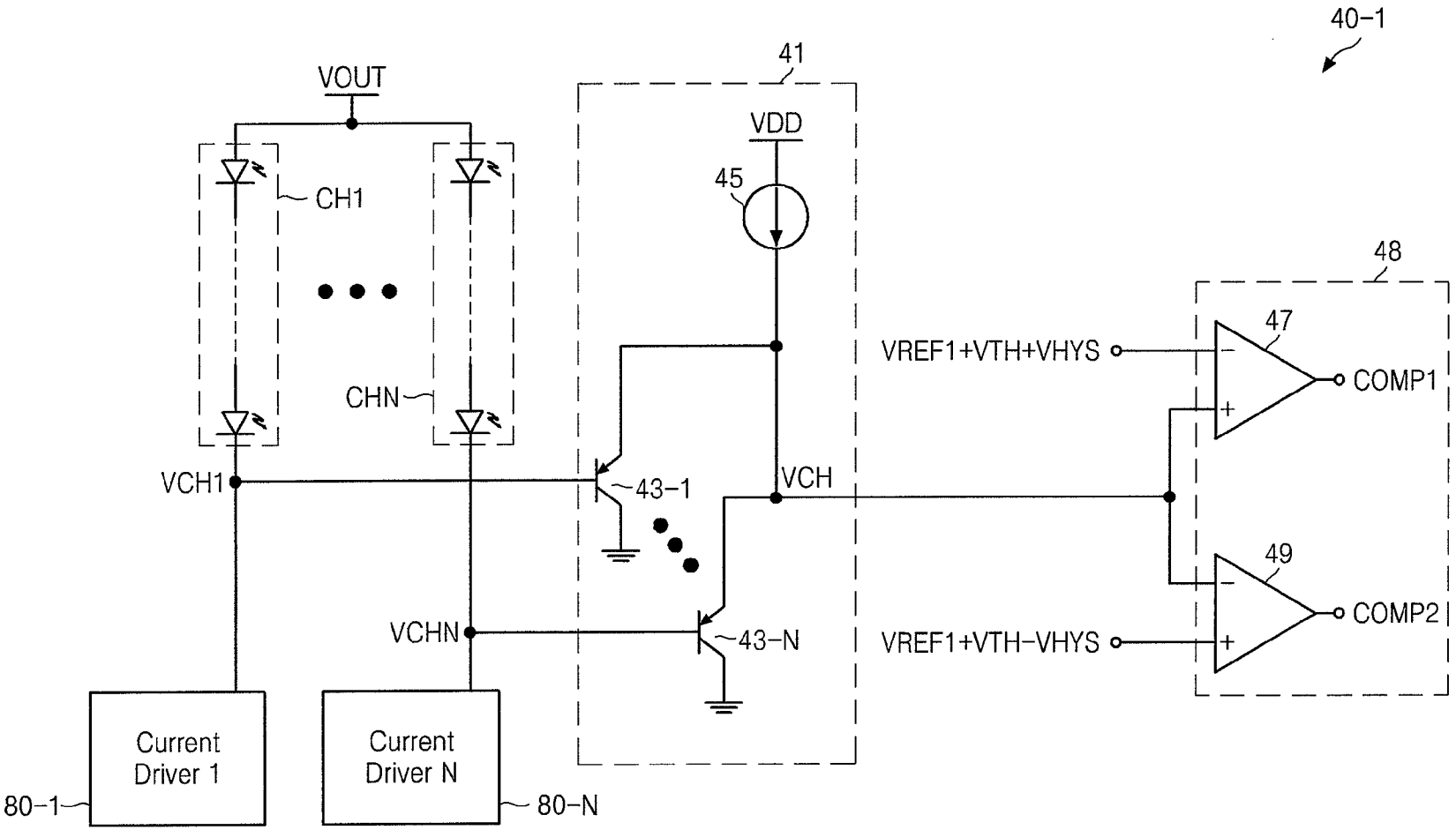
FIG. 2 illustrates a circuit diagram of an exemplary embodiment of a comparison circuit employable in the back light unit illustrated in FIG. 1.

FIG. 2 illustrates a circuit diagram of an exemplary embodiment of a comparison circuit 40-1 employable in the back light unit 30 illustrated in FIG. 1. Referring to FIGS. 1 and 2, the comparison circuit 40-1 may include a detection circuit 41 and a comparison unit 48.

The detection circuit 41 may detect a minimum voltage generated according to each of the output voltages VCH1 through VCHN of the respective light source channels CH1 through CHN and a voltage generated based on a current generated by a current source 45. The detection circuit 41 may include a plurality of bipolar junction transistors (BJTs) 43-1 through 43-N, each of which may be connected between the current source 45 and ground.

The BJTs 43-1 through 43-N may respectively receive the output voltages VCH1 through VCHN of the respective light source channels CH1 through CHN through their bases. When the base and an emitter of one of the BJTs 43-1 through 43-N is forward biased, a current path may be formed between the emitter and the collector of the BJT. Accordingly, the detection circuit 41 may detect as the minimum voltage an output voltage VCH of a respective light source channel connected to the BJT among the output voltages VCH1 through VCHN of the light source channels CH1 through CHN.

The comparison unit 48 may compare the detected voltage VCH with each of reference voltages and may output the comparison signals COMP1 and COMP2. The reference voltages may include a first combination voltage and a second combination voltage. The first combination voltage may correspond to a sum of a first reference voltage VREF1, a threshold voltage VTH between the emitter and the base of each of the BJTs 43-1 through 43-N, and a hysteresis voltage VHYS. The second combination voltage may correspond to a result of subtracting the hysteresis voltage VHYS from the sum of first reference voltage VREF1 and the threshold voltage VTH between the emitter and the base of each of the BJTs 43-1 through 43-N.

The comparison unit 48 may include a first comparator 47 and a second comparator 49. The first comparator 47 may compare the detected voltage VCH with one of the reference voltages, e.g., the first combination voltage, and may output one, e.g., COMP1, of the comparison signals COMP1 and COMP2. The second comparator 49 may compare the detected voltage VCH with another one of the reference voltages, e.g., the second combination voltage, and may output another one, e.g., COMP2, of the comparison signals COMP1 and COMP2.

When a level of the detected voltage VCH is higher than the level of the first combination voltage, one of the comparison signals COMP1 and COMP2, e.g., the first comparison signal COMP1, may be output at the high level. When the level of the detected voltage VCH is lower than the level of the second combination voltage, another one of the comparison signals COMP1 and COMP2, e.g., the second comparison signal COMP2, may be output at the high level. When the level of the detected voltage VCH is lower than the level of the first combination voltage and higher than the level of the second combination voltage, the comparison signals COMP1 and COMP2 may all be output at the low level.

Each of the light source channels CH1 through CHN may include a plurality of light sources connected in series. Accordingly, when one of the light sources is open, current may not flow in a channel including the open light source. For instance, when one of a plurality of light sources is open in the first channel CH1 including the light sources, current may not flow in the first channel CH1. Under such circumstances, the output voltage VCH1 of the first channel CH1 may be 0 V. Further, under such circumstances, even through the output voltage VCH1 of the first channel CH1 may not be the minimum voltage among the output voltages VCH1 through VCHN of the light source channels CH1 through CHN, the detection circuit 41 may detect the output voltage VCH1 of the first channel CH1 as the minimum voltage. Since the level of the detected voltage VCH is lower than the level of the second combination voltage, the second comparison signal COMP2 may be output at the high level. Then, the adjusting circuit 50 may raise the voltage VOUT applied to the light source channels CH1 through CHN.

Accordingly, in some embodiments, when detecting the minimum voltage, a channel including an open light source among the light source channels CH1 through CHN may be excluded and a circuit for excluding the open channel may be employed so that the detection circuit 41 may detect the minimum voltage with respect to the light source channels CH1 through CHN except for the open channel.

Figure 3:
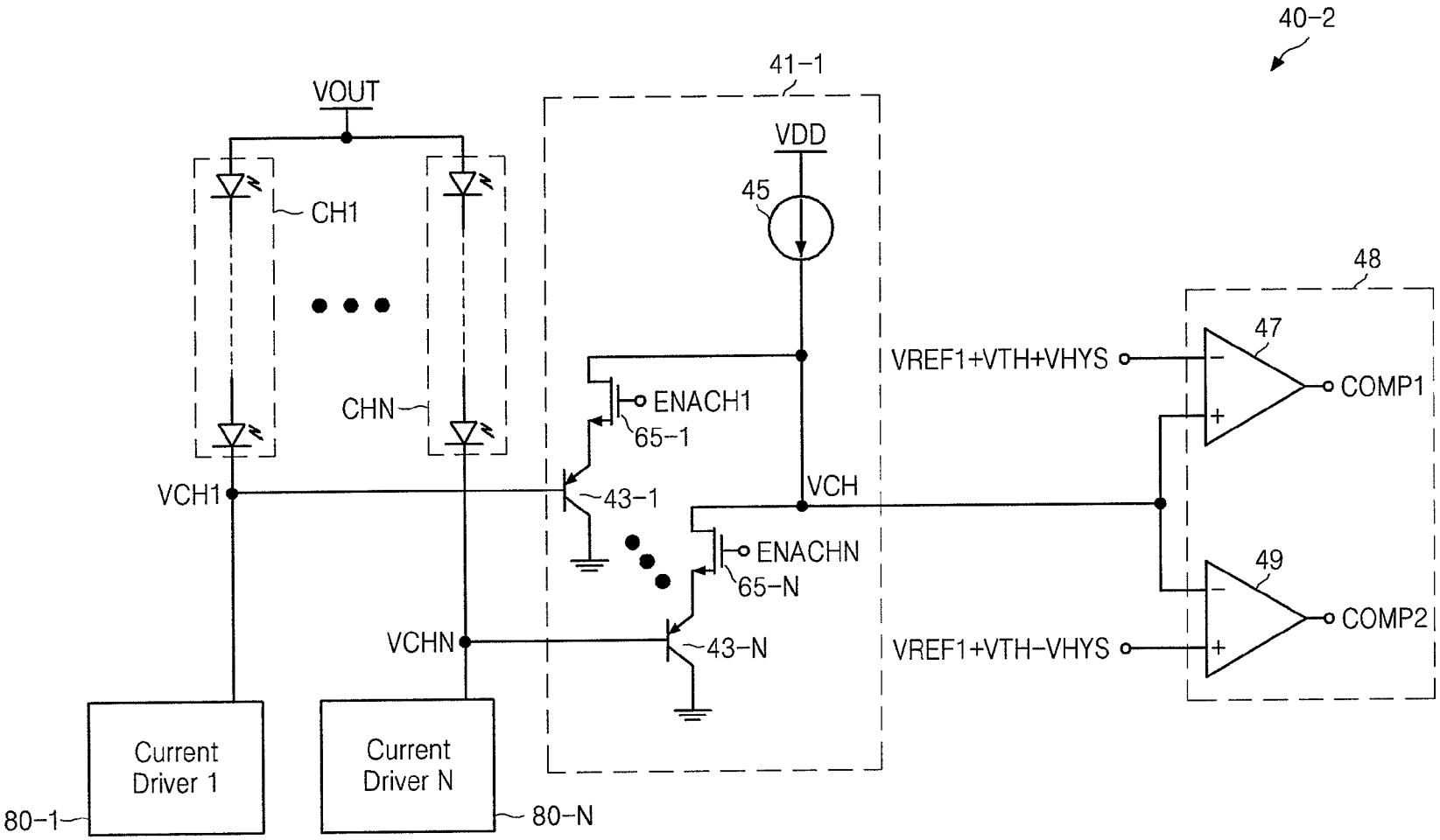
FIG. 3 illustrates a circuit diagram of another exemplary embodiment of a comparison circuit employable in the back light unit illustrated in FIG. 1.

FIG. 3 illustrates a circuit diagram of another exemplary embodiment of a comparison circuit 40-2 employable in the back light unit 30 illustrated in FIG. 1. In general, only differences between the exemplary embodiment of FIG. 3 and the exemplary embodiment of FIG. 2 will be described below. Referring to FIGS. 1 through 3, a detection circuit 41-1 may be adapted to exclude an open channel. More particularly, e.g., the detection circuit 41-1 may further include a plurality of switches 65-1 through 65-N, which may be employed to exclude an open channel.

The switches 65-1 through 65-N may be connected between the current source 45 and the emitters, respectively, of the BJTs 43-1 through 43-N. The switches 65-1 through 65-N may be implemented by metal-oxide semiconductor (MOS) transistors. The switches 65-1 through 65-N may be turned on or off by each of a plurality of switch enable signals ENACH1 through ENACHN, respectively, output from a channel open sensing circuit (not shown).

When one channel, e.g., the first channel CH1, among the light source channels CH1 through CHN includes an open light source, the channel open sensing circuit may sense that the first channel CH1 includes the open light source and may output a first switch enable signal ENACH1 to turn off the first switch 65-1. The first switch 65-1 is turned off in response to the first switch enable signal ENACH1. Accordingly, the channel CH1 including the open light source may be excluded and the detection circuit 41-1 may detect the minimum voltage with respect to the light source channels CH1 through CHN except for the first channel CH1.

When the light sources of the light source channels CH1 through CHN are all short-circuited, the output voltages VCH1 through VCHN of each of the light source channels CH1 through CHN may have the level of the voltage VOUT. Under such conditions, the base and the emitter of each of the BJTs 43-1 through 43-N may not be forward biased. Further, under such conditions, a current path may not be formed between the emitter and the collector of each of the BJTs 43-1 through 43-N. Under such circumstances, the detection circuit 41-1 may detect a current control voltage VDD generated by the current source 45 as the minimum voltage.

Further, since the level of the detected voltage VCH is higher than the level of the first combination voltage, one of the comparison signals COMP1 and COMP2, e.g., the first comparison signal COMP1, may be output at the high level. Accordingly, the adjusting circuit 50 may lower the voltage VOUT applied to the light source channels CH1 through CHN, respectively. Therefore, some embodiments may include a circuit for considering this state when all light sources of the light source channels CH1 through CHN are short-circuited.

Figure 4:
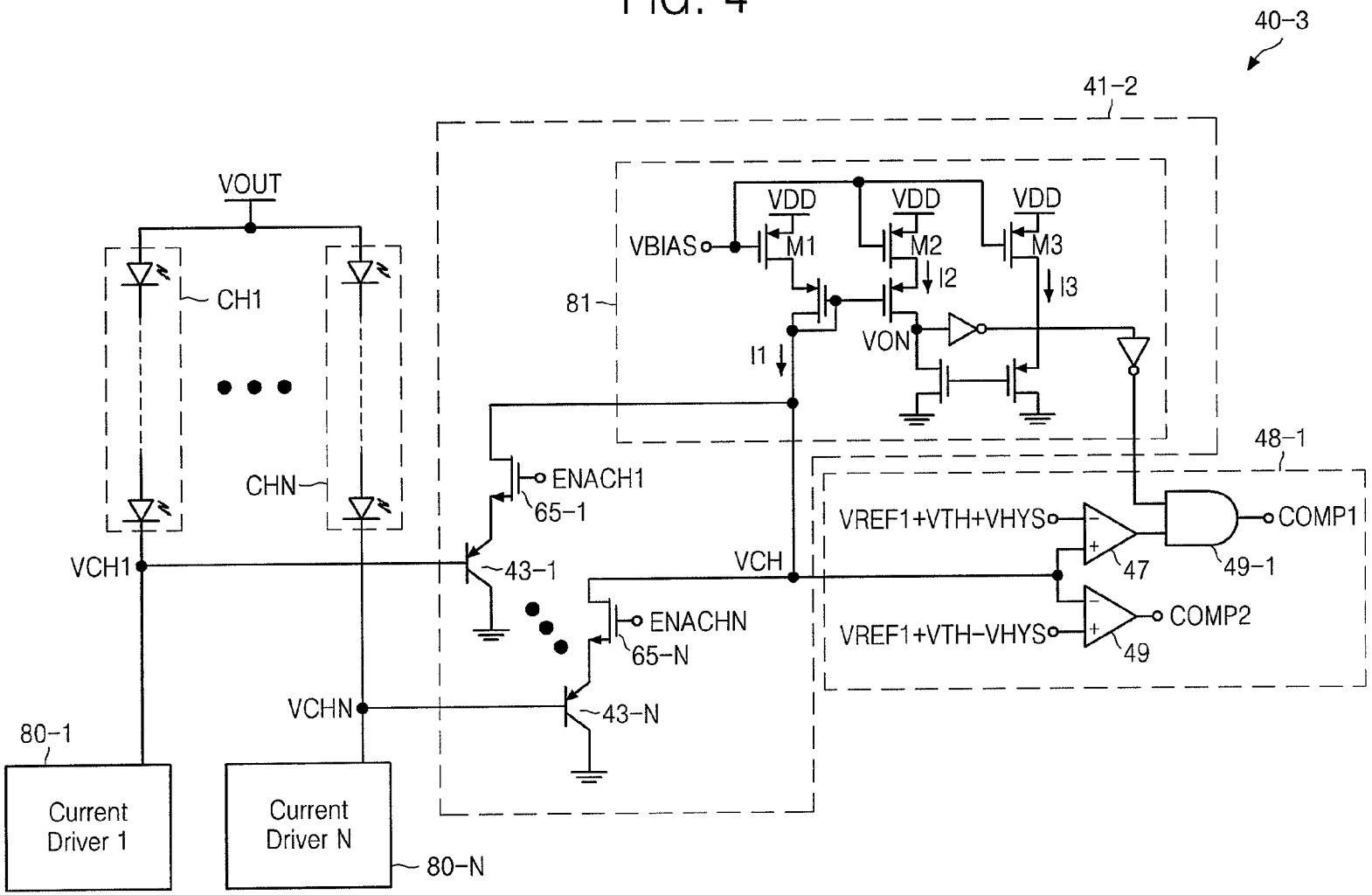
FIG. 4 illustrates a circuit diagram of another exemplary embodiment of a comparison circuit employable in the back light unit illustrated in FIG. 1.

FIG. 4 illustrates a circuit diagram of another exemplary embodiment of a comparison circuit 40-3 employable in the back light unit 30 illustrated in FIG. 1. In general, only differences between the exemplary embodiment of FIG. 4 and the exemplary embodiment of FIG. 3 will be described below. Referring to FIGS. 1 and 4, the comparison circuit 40-3 may include a detection circuit 41-2 and a comparison unit 48-1. The detection circuit 41-2 may detect the minimum voltage according to each of the output voltages VCH1 through VCHN of the respective light source channels CH1 through CHN and a voltage generated based on a current I1 generated by a current source 81.

The current source 81 may be implemented by a current mirror. The current mirror 81 may generate the current I1 and a mirror current I2. The current mirror 81 may include a plurality of transistors which have different ratios of channel width to channel length (W/L). For instance, the W/L ratio a first transistor M1 and a second transistor M2 may be two times greater than that of a third transistor M3.

The plurality of transistors may be implemented by MOS transistors. Of those transistors, e.g., the first through third transistors M1 through M3, may be driven by a bias voltage VBIAS.

When all light sources of the light source channels CH1 through CHN are short-circuited, the output voltages VCH1 through VCHN of the light source channels CH1 through CHN all have the level of the voltage VOUT. Under such circumstances, the base and the emitter of each of the BJTs 43-1 through 43-N may not be forward biased, and therefore, a current path is not formed between the emitter and the collector of each of the BJTs 43-1 through 43-N and the current I1 is 0. Since the current I1 is 0, the mirror current I2 is also 0. Since the mirror current I2 is 0, a node voltage VON is 0. Since the node voltage VON corresponding to a signal generated by the mirror current I2 is 0, one of the comparison signals COMP1 and COMP2, e.g., the first comparison signal COMP1, is output at the low level regardless of the detected voltage VCH.

When light sources of at least one of the light source channels CH1 through CHN are not short-circuited, the base and the emitter of a BJT corresponding to the channel including the non-short-circuited light sources are forward biased and a current path is formed between the emitter and the collector of the BJT. Accordingly, the current I1 may be increased by the current mirror 81 to be, e.g., two times a reference current I3.

Since the current I1 may be, e.g., two times the reference current I3, the mirror current I2 may also be two times the reference current I3 and the node voltage VON may have the level of the current control voltage VDD. Accordingly, the comparison unit 48-1 may compare the detected voltage VCH with one of the reference voltages VREF1+VTH+VHYS and VREF1+VTH̃VHYS, e.g., the first combination voltage VREF1+VTH+VHYS, and may output an intermediate comparison signal based on the comparison result as one of the comparison signals COMP1 and COMP2, e.g., the first comparison signal COMP1.

The comparison unit 48-1 may include the first comparator 47, the second comparator 49, and a logic gate 49-1. The comparison unit 48-1 may output intermediate comparison signals based on a result of comparing the detected voltage VCH with the reference voltages VREF1+VTH+VHYS and VREF1+VTH̃−VHYS. The comparison unit 48-1 may output one of the comparison signals COMP1 and COMP2, e.g., the first comparison signal COMP1, a signal resulting from a logic operation on one of the intermediate comparison signals and the signal VON generated by the mirror current I2 of the current I1. The comparison unit 48-1 may output another one of the intermediate comparison signals as another one of the comparison signals COMP1 and COMP2, e.g., the second comparison signal COMP2.

Figure 5:
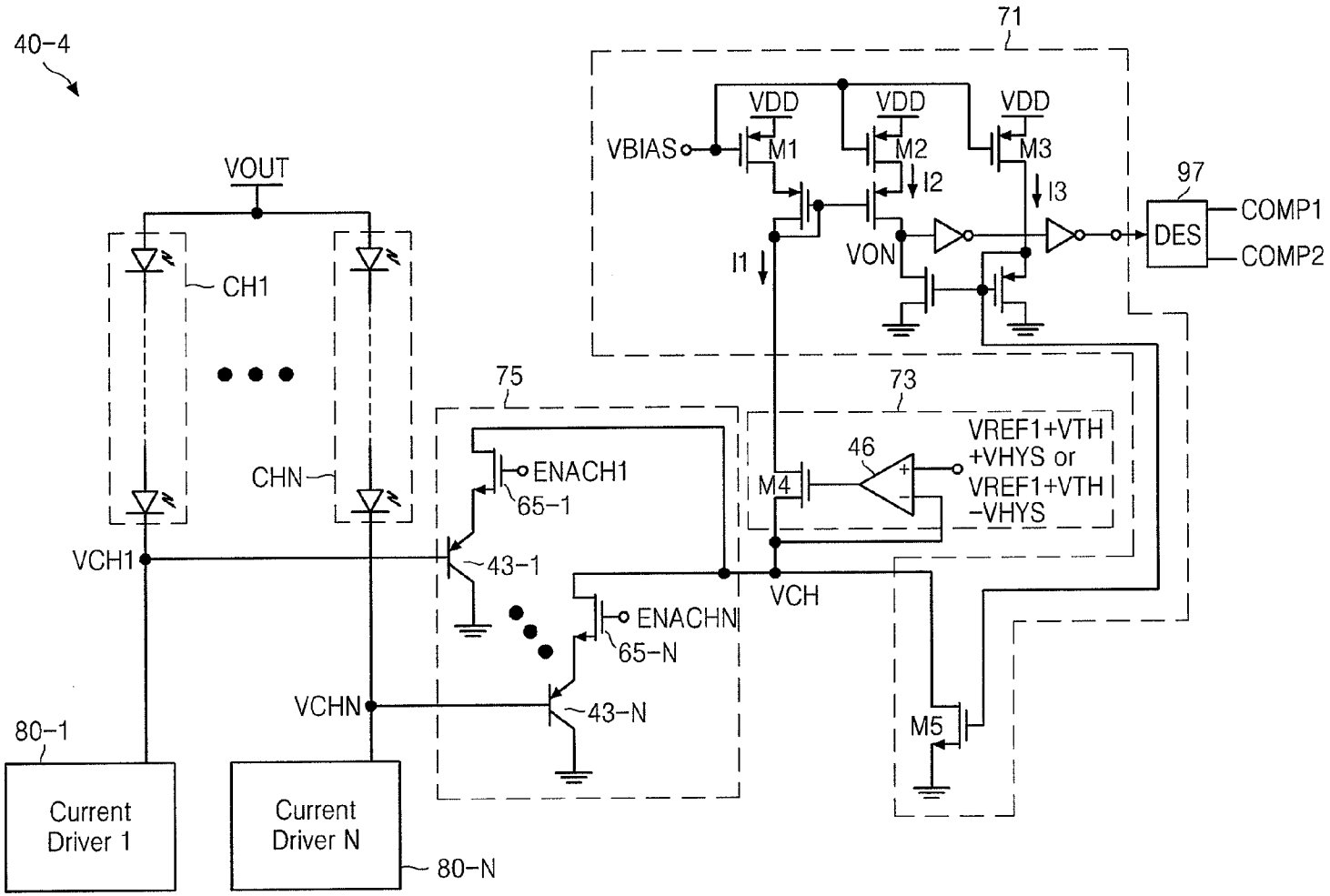
FIG. 5 illustrates a circuit diagram of another exemplary embodiment of a comparison circuit employable in the back light unit illustrated in FIG. 1.

FIG. 5 illustrates a circuit diagram of another exemplary embodiment of a comparison circuit 40-4 employable in the back light unit 30 illustrated in FIG. 1. In general, only differences between the exemplary embodiment of FIG. 4 and the exemplary embodiment of FIG. 2-4 described above will be described below. Referring to FIGS. 1 and 5, the comparison circuit 40-4 may include a current mirror 71 including a deserializer 97, a switching circuit 73, and a detection circuit 75.

The current mirror 71 may generate the current I1. The current mirror 71 may include a plurality of transistors which have different sizes. The transistors may be implemented by MOS transistors. Of those transistors, e.g., the first transistor M1, the second transistor M2, and the third transistor M3 may be driven by a bias voltage VBIAS.

The switching circuit 73 may transmit the current I1 to a node in response to a voltage VCH of the node and each of a plurality of the reference voltages VREF1+VTH+VHYS and VREF1+VTH−VHYS, which may be sequentially applied.

When one of the reference voltages VREF1+VTH+VHYS and VREF1+VTH−VHYS, e.g., the first combination voltage VREF1+VTH+VHYS, is applied to a positive terminal of an amplifier 46, the voltage VCH of the node may have the level of the first combination voltage VREF1+VTH+VHYS. Accordingly, when the level of each of the output voltages VCH1 through VCHN of the light source channels CH1 through CHN is higher than the level of a voltage VREF1+VHYS resulting from subtracting the threshold voltage VTH between the emitter and the base of each of the BJTs 43-1 through 43-N from the first combination voltage VREF1+VTH+VHYS, a current path is not fanned between the emitter and the collector of each of the BJTs 43-1 through 43-N and the current I1 may be (¼)I3. The level of the node voltage VON of the current mirror 71 may be 0 and one of the comparison signals COMP1 and COMP2, e.g., the first comparison signal COMP1, may be output at the high level.

When one of the output voltages VCH1 through VCHN, e.g., the output voltage VCH1 of the first channel CH1, is lower than the level of the voltage VREF1+VHYS resulting from subtracting the threshold voltage VTH between the emitter and the base of each of the BJTs 43-1 through 43-N from the first combination voltage VREF1+VTH+VHYS, a current path may be formed between the emitter and the collector of the first BJT 43-1 and the current I1 may be the same as the current I3. The level of the node voltage VON of the current mirror 71 may become high and one of the comparison signals COMP1 and COMP2, e.g., the first comparison signal COMP1, may be output at the low level.

When one of the reference voltages VREF1+VTH+VHYS and VREF1+VTH−VHYS, e.g., the second combination voltage VREF1+VTH̃−VHYS, is applied to the positive terminal of the amplifier 46, the voltage VCH of the node has the level of the second combination voltage VREF1+VTH−VHYS. Accordingly, when the level of each of the output voltages VCH1 through VCHN of the light source channels CH1 through CHN is higher than the level of a voltage VREF1−VHYS resulting from subtracting the threshold voltage VTH between the emitter and the base of each of the BJTs 43-1 through 43-N from the second combination voltage VREF1+VTH−VHYS, a current path is not formed between the emitter and the collector of each of the BJTs 43-1 through 43-N and the current I1 is (¼)I3. The level of the node voltage VON of the current mirror 71 may become 0 and one of the comparison signals COMP1 and COMP2, e.g., the second comparison signal COMP2, may be output at the high level.

When one of the output voltages VCH1 through VCHN, e.g., the output voltage VCH1 of the first channel CH1, is lower than the level of the voltage VREF1-VHYS resulting from subtracting the threshold voltage VTH between the emitter and the base of each of the BJTs 43-1 through 43-N from the second combination voltage VREF1+VTH−VHYS, a current path may be formed between the emitter and the collector of the first BJT 43-1 and the current I1 is the same as the current I3. The level of the node voltage VON of the current mirror 71 may become high and one of the comparison signals COMP1 and COMP2, e.g., the second comparison signal COMP2, may be output at the high level.

The deserializer 97 may sequentially buffer the mirror current I2 of the current I1 and generates a plurality of deserialized buffer signals, i.e., the comparison signals COMP1 and COMP2.

Figure 6:
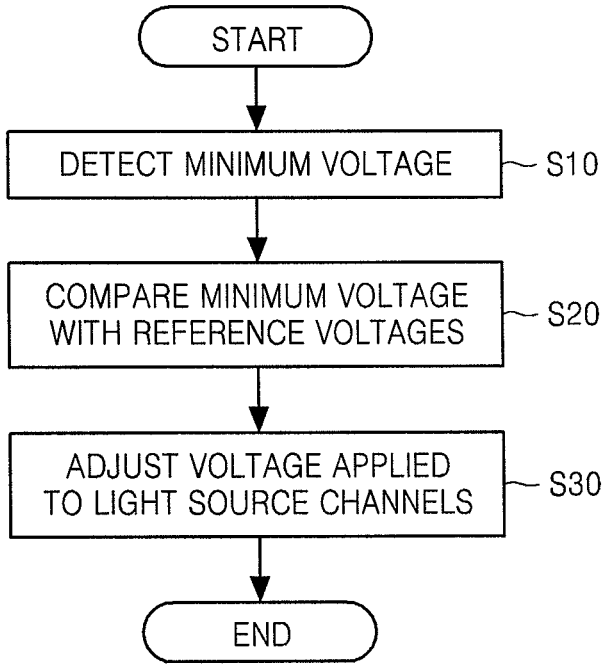
FIG. 6 illustrates a flowchart of an exemplary operation of the light source driver of the back light unit illustrated in FIG. 1.

FIG. 6 illustrates a flowchart of an exemplary operation of the light source driver 10 of the back light unit 30 illustrated in FIG. 1. In some embodiments, a comparison circuit, e.g., the comparison circuits 40-1 through 40-4 illustrated in FIGS. 2 through 5, respectively, may be employed as the comparison circuit 40 illustrated in FIG. 1.

Referring to FIG. 6, during S10, a minimum voltage among the output voltages VCH1 through VCHN of the light source channels CH1 through CHN may be detected using, e.g., the comparison circuit 40. During S20, the detected voltage may be compared with each of the reference voltages VREF1+VTH+VHYS and VREF1+VTH−VHYS, and a comparison signal, e.g., the comparison signals COMP1 and COMP2, may be output. During S30, the adjusting circuit 50 may adjust the voltage VOUT applied to the light source channels CH1 through CHN in response to the comparison signal, e.g., the comparison signals COMP1 and COMP2.

Figure 7:
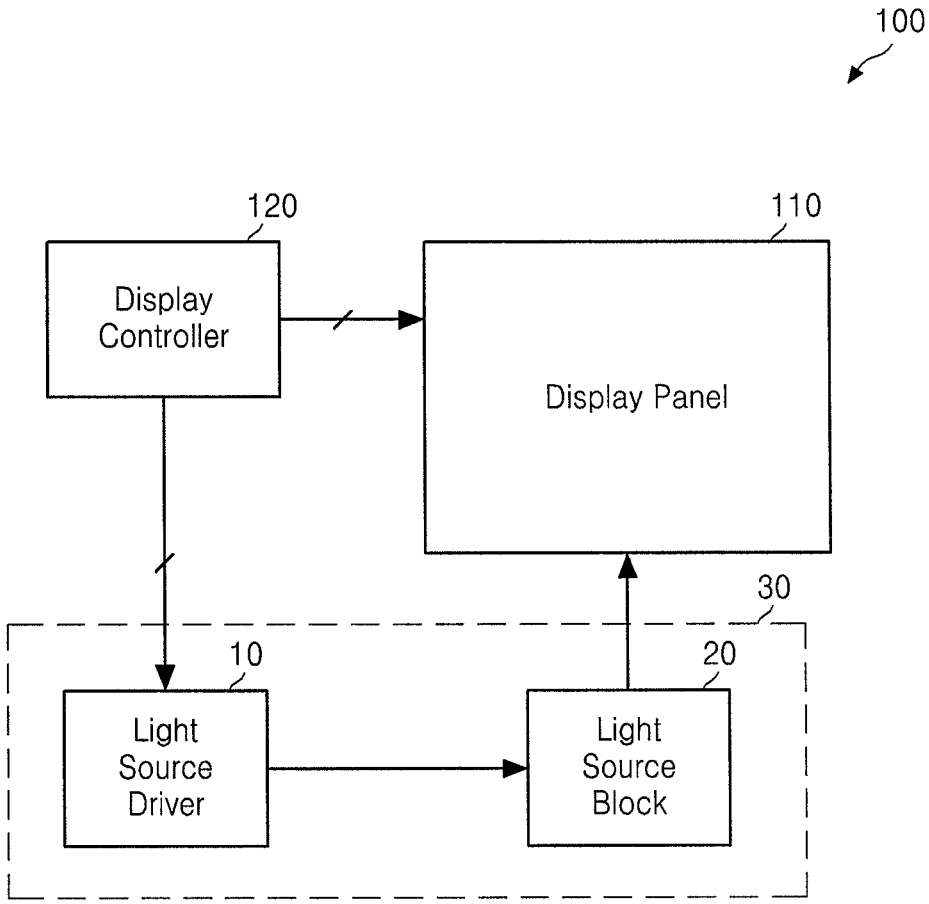
FIG. 7 illustrates a block diagram of a display device including the light source driver illustrated in FIG. 1.

FIG. 7 illustrates a block diagram of a display device 100 including the light source driver 10 illustrated in FIG. 1.

Referring to FIGS. 1 through 7, the display device 100 may include a display panel 110, a display controller 120, and the back light unit 30.

The display panel 110 may display data according to light sources of the back light unit 30 in response to a plurality of control signals output from the display controller 120. The display controller 120 may output the plurality of control signals for controlling the display panel 110, and a plurality of control signals for controlling the back light unit 30. The back light unit 30 may include the light source block 20 including the light source channels CH1 through CHN, and the light source driver 10.

Embodiments may provide a light source driver, e.g., the light source driver 10 described above with reference to FIGS. 1 through 6, that may adjust and/or apply a voltage, e.g., the voltage VOUT, to the light source channels CH1 through CHN in response to the control signals output from the display controller 120.

Figure 8:
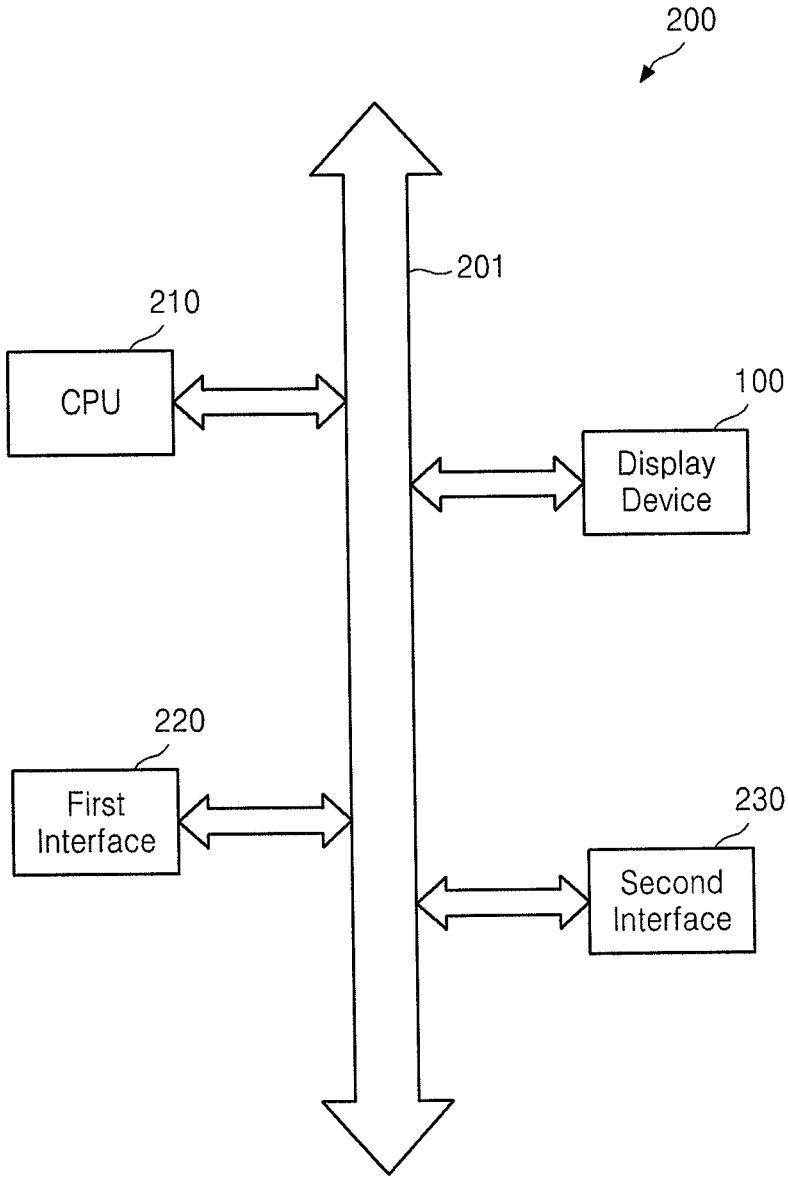
FIG. 8 illustrates a block diagram of an exemplary embodiment of a display system including the display device illustrated in FIG. 7.

FIG. 8 illustrates a block diagram of an exemplary embodiment of a display system 200 including the display device 100 illustrated in FIG. 7.

Referring to FIGS. 1 through 8, the display system 200 may be implemented in a personal computer (PC), a portable computer, a handheld communication device, a digital television (TV), a home automation system, etc.

The display system 200 may include the display device 100 and a central processing unit (CPU) 210, which may be connected to each other via a system bus 201. The display device 100 and the CPU 210 may communicate data with each other according to a communication protocol. The CPU 210 may control the overall operation of the display device 100, e.g., the operation of the display panel 110 or the back light unit 30. The display device 100 may include, e.g., the back light unit 30 described above with reference to FIGS. 1 through 7.

The display system 200 may also include a first interface 220. The first interface 220 may be an input/output interface. The input/output interface may be an output device, such as a monitor or a printer, or an input device, such as a mouse or a keyboard.

The display system 200 may also include a second interface 230. The second interface 230 may be a wireless communication interface enabling wireless communication with an external computer system.

To sense a voltage of each of the light source channels, multiple comparators, e.g., two comparators may generally be employed for each light source channel. Moreover, when any one of the light source channels is open or all of the light source channels are turned off, a light source driver may not properly operate.

Embodiments of a light source driver including one or more features described herein, and devices including such a light source driver may, e.g., employ a reduced number of comparators, may occupy a reduced and/or minimized area of an integrated circuit (IC), and/or may detect a state where an erroneous operation may occur.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A light source driver, comprising:

an adjusting circuit configured to adjust a voltage applied to each of a plurality of light source channels in response to a plurality of comparison signals; and a comparison circuit configured to compare a minimum voltage among output voltages of the respective light source channels with each of a plurality of reference voltages and output the plurality of comparison signals, the comparison circuit including:

a detection circuit configured to detect the minimum voltage, which is generated according to each of the output voltages of the respective light source channels and a current control voltage generated by a current source; and a comparison unit configured to compare the detected voltage with each of the plurality of reference voltages and output the comparison signals.

2. The light source driver as claimed in claim 1, wherein the comparison unit comprises:

a first comparator configured to compare the detected voltage with one of the plurality of reference voltages and output one of the comparison signals; and a second comparator configured to compare the detected voltage with another one of the plurality of reference voltages and output another one of the comparison signals.

3. The light source driver as claimed in claim 1, wherein the detection circuit comprises a plurality of bipolar junction transistors (BJTs) each of which is connected between the current source and a ground; and wherein bases of the respective BJTs respectively receive the output voltages of the respective light source channels.

4. The light source driver as claimed in claim 3, wherein the detection circuit further comprises a plurality of switches connected between the current source and emitters, respectively, of the respective BJTs.

5. A back light unit, comprising:

a plurality of light source channels; and the light source driver as claimed in claim 1, the light source driver being configured to adjust and apply a voltage to each of the light source channels.

6. The back light unit as claimed in claim 5, wherein:

the detection circuit comprises a plurality of bipolar junction transistors (BJTs) each of which is connected between the current source and a ground, and bases of the respective BJTs respectively receive the output voltages of the respective light source channels.

7. The back light unit as claimed in claim 6, wherein the detection circuit further comprises a plurality of switches connected between the current source and emitters, respectively, of the respective BJTs.

8. A display device, comprising:

a display panel;

the back light unit as claimed in claim 5; and a display controller configured to control an operation of the display panel and an operation of the back light unit.

9. A display system, comprising:

the display device as claimed in claim 8; and a processor configured to control an operation of the display device.

10. A light source driver, comprising:

an adjusting circuit configured to adjust a voltage applied to each of a plurality of light source channels in response to a plurality of comparison signals; and a comparison circuit configured to compare a minimum voltage among output voltages of the respective light source channels with each of a plurality of reference voltages and output the plurality of comparison signals, the comparison circuit including:

a detection circuit configured to detect the minimum voltage according to each of the output voltages of the respective light source channels and a control voltage generated by a current generated by a current source; and a comparison unit configured to output intermediate comparison signals according to a result of comparing the detected voltage with each of the plurality of reference voltages, output a signal resulting from a logic operation on one of the intermediate comparison signals as one of the comparison signals and a signal generated by a mirror current of the current, and output another one of the intermediate comparison signals as another one of the comparison signals.

11. The light source driver as claimed in claim 10, wherein the current source is a current mirror which generates the current and the mirror current.

12. A back light unit, comprising:

a plurality of light source channels; and the light source driver as claimed in claim 10, the light source driver being configured to adjust and apply a voltage to each of the light source channels.

13. The back light unit as claimed in claim 12, wherein the current source is a current mirror configured to generate the current and the mirror current.

14. A display device, comprising:

a display panel;

the back light unit as claimed in claim 12; and a display controller configured to control an operation of the display panel and an operation of the back light unit.

15. A display system, comprising:

the display device as claimed in claim 14; and a processor configured to control an operation of the display device.

16. A light source driver, comprising:

an adjusting circuit configured to adjust a voltage applied to each of a plurality of light source channels in response to a plurality of comparison signals; and a comparison circuit configured to compare a minimum voltage among output voltages of the respective light source channels with each of a plurality of reference voltages and output the plurality of comparison signals, the comparison circuit including:

a current mirror configured to generate a current;

a switching circuit configured to transmit the current to a node in response to a voltage of the node and each of the plurality of reference voltages sequentially applied;

a detection circuit configured to detect the minimum voltage according to each of the output voltages of the respective light source channels and a voltage generated based on the current; and a deserializer configured to sequentially buffer a mirror current of the current and generate a plurality of deserialized buffer signals respectively corresponding to the comparison signals.

17. A back light unit, comprising:

a plurality of light source channels; and the light source driver as claimed in claim 16, the light source driver being configured to adjust and apply a voltage to each of the light source channels.

18. A display device, comprising:

a display panel;

the back light unit as claimed in claim 17; and a display controller configured to control an operation of the display panel and an operation of the back light unit.

19. A display system, comprising:

the display device as claimed in claim 18; and a processor configured to control an operation of the display device.

* * * * *